US005669247A

United States Patent [19]

McCartney et al.

[11] Patent Number: 5,669,247

[45] Date of Patent: Sep. 23, 1997

[54] UNDERWIRE BRASSIERE, WARP KNITTED TEXTILE FABRIC FOR USE IN FABRICATING SAME, AND METHOD OF WARP KNITTING SUCH FABRIC

[75] Inventors: Phillip D. McCartney, Oak Ridge; Hilda E. Allen, High Point, both of N.C.; James G. Donaghy, Emerson, N.J.

[73] Assignee: Guilford Mills, Inc., Greensboro, N.C.

[21] Appl. No.: 704,137

[22] Filed: Aug. 28, 1996

[51] Int. Cl.[6] ..... D04B 21/14; A41B 3/12; A41B 3/14

[52] U.S. Cl. ..... 66/195; 450/49; 450/52; 66/171

[58] Field of Search ..... 66/171, 195, 84 R; 450/41, 42, 43, 44, 45, 46, 47, 48, 49, 50, 51, 52, 53

[56] References Cited

U.S. PATENT DOCUMENTS 2,622,244 12/1952 Alberts ..... 450/49
2,954,031 9/1960 Froelich ..... 450/49 X
4,015,451 4/1977 Gajjar ..... 66/195
4,418,696 12/1983 Delet ..... 450/52

*Primary Examiner*—John J. Calvert
*Attorney, Agent, or Firm*—Shefte, Pinckney & Sawyer

[57] ABSTRACT

In an underwire brassiere, a generally inelastic and dimensionally stable two-bar warp knitted fabric is provided as a covering for the underwire. One set of warp yarns is knitted in a pattern of coursewise spaced stitches with extended underlaps and another set of warp yarns is knitted in a chain stitch pattern, collectively providing warpwise and coursewise stability and elongation resistance to the fabric. The run-in ratio of the two sets of warp yarns imparts a controlled coursewise inclination to the chain stitches enabling a predetermined degree of walewise elongation for better conformation of the fabric to the underwire in fabrication of the brassiere.

31 Claims, 3 Drawing Sheets

UNDERWIRE BRASSIERE, WARP KNITTED TEXTILE FABRIC FOR USE IN FABRICATING SAME, AND METHOD OF WARP KNITTING SUCH FABRIC

BACKGROUND OF THE INVENTION

The present invention relates generally to women's foundation-type undergarments, especially brassieres of the so-called underwire type. More particularly, the present invention relates to an underwire brassiere wherein a novel warp knitted textile fabric is utilized for covering the underwire and a novel warp knitting process by which such fabric is made.

In conventional brassieres, it is known to incorporate wire or similar stiffening elements when necessary or desirable to provide supplementary support, lift and/or separation of the wearer's breasts. Most commonly, wire or like stiffening elements are located along the lower edge margins of a brassiere's breast cups and configured to conform to the size and shape of the cups. In use, the wire or like stiffening element is intended to be held firmly against the torso of the wearer directly beneath the breasts to provide optimal support.

The comfort of the wearer and, particularly, the prevention of the wire or stiffening element from presenting discomfort to the wearer are two of the critical concerns which have existed since the original introduction of such so-called "underwire" brassieres. Traditionally, women's brassieres have been constructed exclusively of textile fabrics presenting a sheer, smooth surface to promote comfort over extended periods of wear. Hence, the introduction into a brassiere of a wire or similar stiffening element can significantly alter the normal feel of the brassiere to the wearer.

To minimize any alteration of an underwire brassiere's feel to the wearer in comparison to other brassieres, the underwire or other stiffening element is completely enclosed and contained within a fabric channel normally formed as a hem or a narrow-width band sewn along the lower margin of the breast cups. However, because of the marked distinction between the flexibility of textile fabrics and the relative inflexibility of an underwire or like stiffener, problems have been encountered in the tendency of the covering fabric of the channel and the wire to move relative to one another during wearing, sometimes resulting in an end of the underwire penetrating through the covering into contact with the wearer's body.

Various types of fabrics and various configurations of fabric channels have been utilized over the years to attempt to mitigate such problem. For example, some underwire brassieres are constructed with distinct front and back fabric plies capturing the wire stiffener between the two plies and between two conforming seams sewn between the plies along opposite sides of the wire. Other conventional brassieres utilize a single elongate band of fabric folded lengthwise about the longitudinal extent of the wire or other stiffening element, with the thusly adjoining lengthwise edges of the band then being sewn by a single seam in place along the lower margin of a corresponding breast cup in the brassiere.

Knitted and woven fabrics of various constructions, ranging from elasticated fabrics to inelastic stabilized fabrics, have been utilized over the years for fabricating such underwire channels. Currently, most underwire brassieres utilize a woven taffeta-style fabric as the channel covering material of choice and, normally, such fabric is cut on the bias in an attempt to optimize conformity of the fabric to the shape and configuration of the underwire and to minimize the potential for wire penetration through the fabric covering.

Despite all such efforts within the industry, the tendency of the wire or other stiffening elements utilized in such underwire brassieres to penetrate through the fabric covering material continues to be a recognized problem and has prevented underwire brassieres from becoming more widely accepted and utilized. A need clearly exists for an improved form of textile fabric for use as an underwire covering material in brassieres which will more effectively resist and prevent wire penetration.

SUMMARY OF THE INVENTION

It is accordingly an object of the present invention to provide a novel textile fabric which will overcome the problems currently faced within the relevant industry. More particularly, it is an object of the present invention to provide a novel textile fabric which can be made suitably for such purposes by a warp knitting process.

Briefly summarized, the warp knitted textile fabric of the present invention is characterized by a generally inelastic and dimensionally stable stitch structure formed by warp knitting two sets of generally inelastic warp yarns into stitches arranged in longitudinally extending fabric wales and transversely extending fabric courses, the stitches of the first set of warp yarns being knitted in a coursewise spaced pattern with extended underlaps therebetween and the stitches of the second set of warp yarns being knitted in walewise alignment in a chain stitch pattern. In this manner, the two sets of warp yarns cooperate to provide structural stability and resistance to elongation in both the coursewise and walewise extents of the fabric.

In accordance with a particular feature of the present invention, the chain stitches of the second set of warp yarns are canted in a coursewise inclination relative to the walewise alignment of the yarns to provide the fabric with a predetermined degree of walewise elongation, thereby to promote the ability of the fabric to conform to the shape of the underwire during fabrication of the brassiere. According to the novel warp knitting method of the present invention, such canting of the chain stitches in the fabric is accomplished by warp knitting first and second sets of yarns at selectively differing run-in values to cause the described canting of the chain stitches of the second yarns.

In an underwire brassiere according to the present invention, the above-described fabric is utilized to form an underwire channel extending along a lower margin of each of a pair of adjoining breast cups in the brassiere, so as to be disposed immediately beneath a user's breasts during wearing. With a conforming underwire extending through the channel, the structural stability of the present fabric serves to essentially resist and largely prevent penetration through the fabric by the underwire.

In the preferred embodiment, the fabric of the present invention is of a relatively fine gauge having the stitches of the first and second sets of warp yarns sufficiently closely spaced for promoting the dimensional stability of the stitch structure and enhancing the resistance of the fabric to penetration by the underwire. Nylon yarns ranging in denier between 20 and 50 are preferred in knitting the present fabric.

For example, in one desirable embodiment, the first set of warp yarns are multifilament nylon yarns of approximately 40 denier warp knitted in a 1-0, 3-4 stitch pattern and the second set of warp yarns are monofilament nylon yarns of approximately 30 denier warp knitted in a 1-0, 0-1 chain stitch pattern in a sufficiently fine gauge to achieve at least about 40 wales and 80 courses per square inch of fabric.

It is further preferred that the warp knitted fabric undergo a finishing treatment subsequent to knitting in order to enhance the fabric's abrasion resistance. For such purpose, a finish composition combining an acrylic-based abrasion resistive composition and a silicone-based fabric softening composition may be applied by a pad-type application process during a heat setting operation typically performed in finishing warp knitted fabrics.

DETAILED DESCRIPTION OF THE PREFERRED EMBODIMENT

Figure 1:
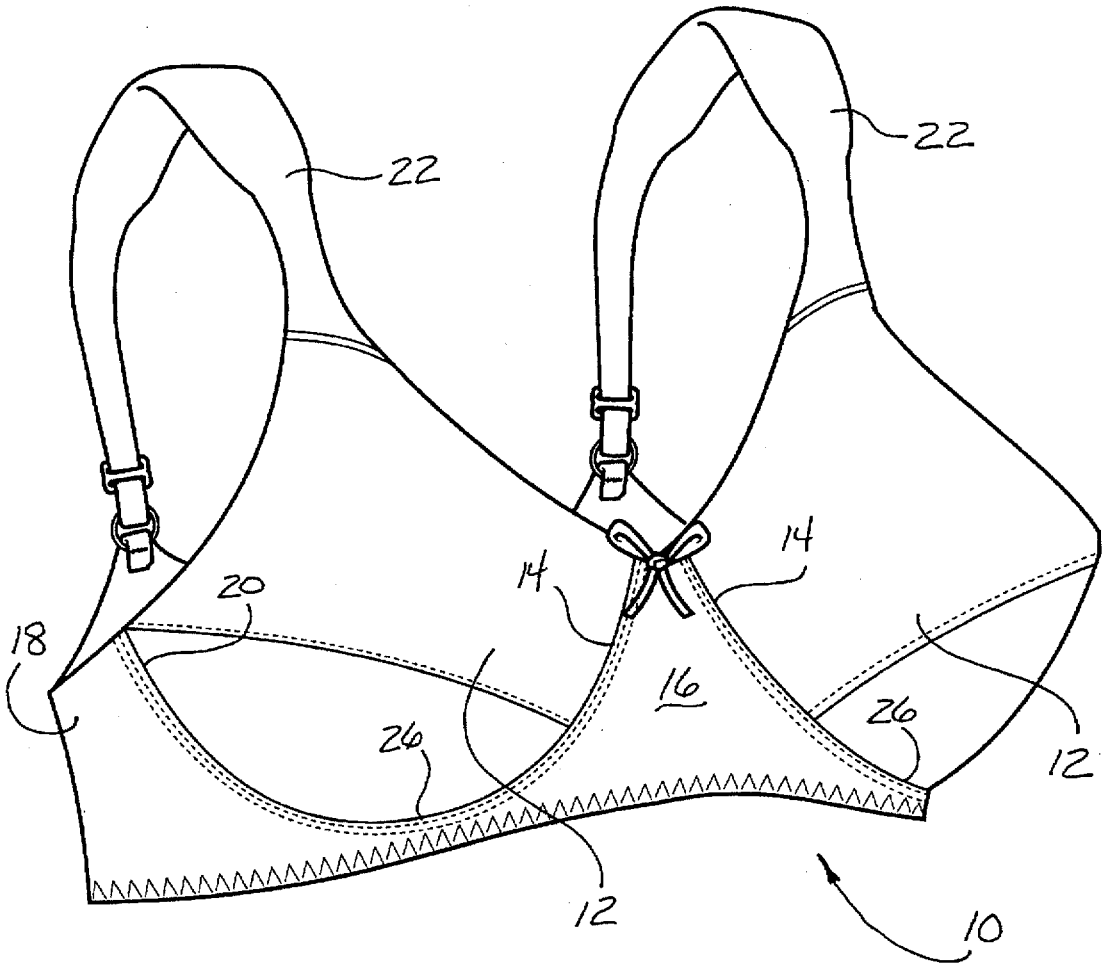
FIG. 1 is a front perspective view of an underwire brassiere of the type which may be fabricated in accordance with the present invention utilizing the novel warp knitted textile fabric described herein.
Figure 2:
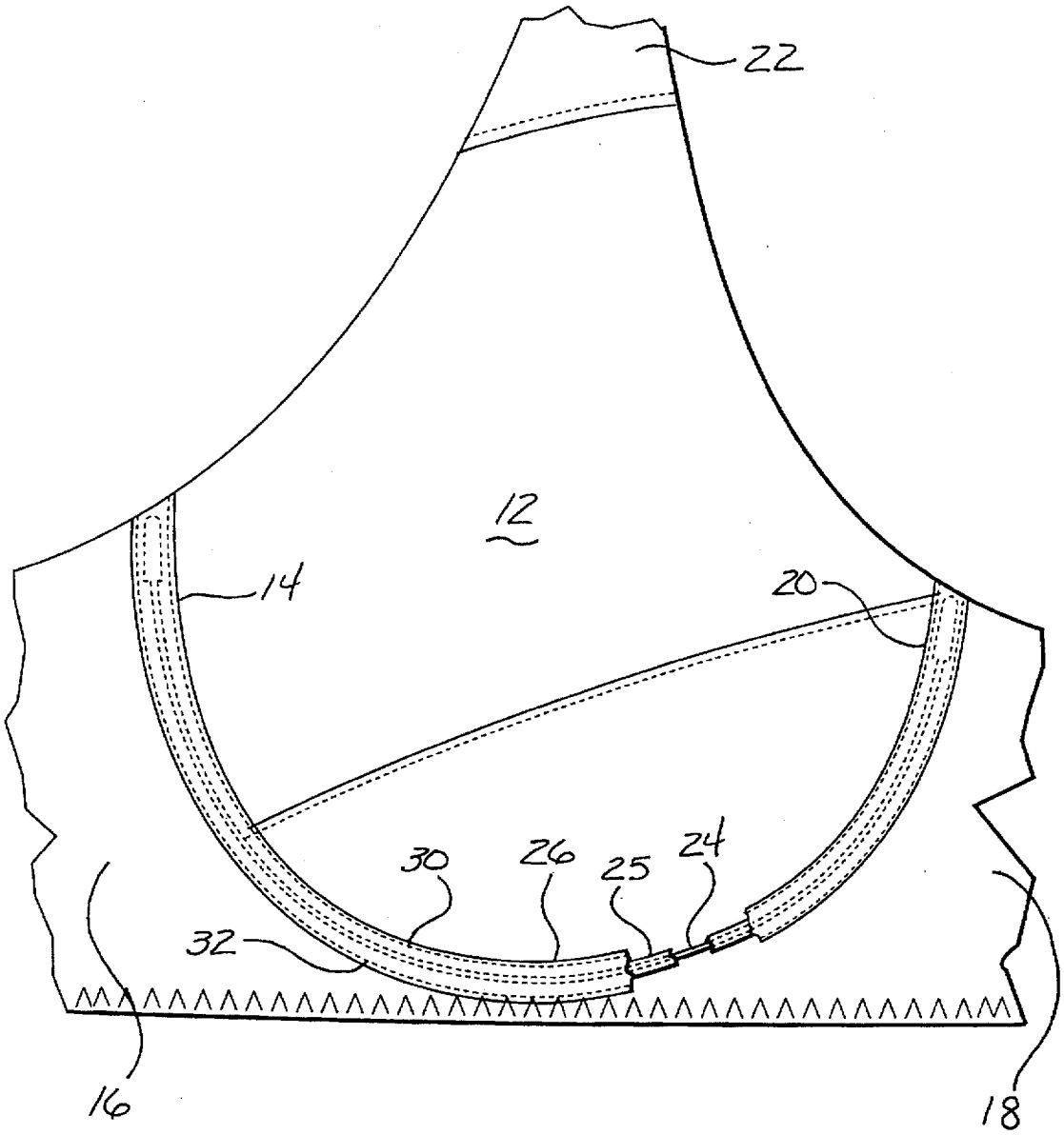
FIG. 2 is a partial rear elevational view of one breast cup of the underwire brassiere of FIG. 1, depicting the warp knitted underwire covering fabric of the present invention.

Referring now to the accompanying drawings and initially to FIGS. 1 and 2, an underwire brassiere of a generally conventional construction (except having the warp knitted fabric of the present invention incorporated as an underwire covering as more fully described herein) is depicted generally at 10. The brassiere 10 basically comprises a pair of breast cups 12 connected along adjacent inner margins 14 by an intermediate gusset panel 16, with a side panel 18 extending from the opposite outer margin 20 of each breast cup 12 and shoulder straps 22 extending between each side panel 18 and an upper edge of the adjacent breast cup 12. The side panels 18 respectively carry hook-and-eye fastener members (not shown) to enable the brassiere 10 to be selectively secured about and removed from encircling disposition about the torso of a wearer.

As best seen in FIG. 2, a U-shaped stiffening wire element 24 extends along the lower margin 26 of each breast cup 12 and continuously therefrom upwardly along the inner and outer side margins 14,20 of the breast cups 12, the stiffening wire 24 being secured in such disposition by a correspondingly U-shaped narrow band of fabric 28 sewn to the respective breast cup 12 along inner and outer seams 30,32 at opposite lateral sides of the wire 24, thereby capturing the wire between the seams 30,32 and sandwiching the wire between the fabric of the breast cup 12 and the covering band 28. For optimal security in enclosing the wire 24, the covering band 28 may be folded to cover both front and back sides of the wire 24 before being sewn along the seams 30,32 and, if necessary or desirable, a fibrous wrapping 25 may be placed about the wire 24 within the covering band 28 to provide a more cushioned feel against the body of the wearer.

As thus far described, the brassiere 10 is of an essentially conventional construction. As discussed above, the present invention provides a novel warp knitted construction to the fabric of the covering band 28 by which the fabric is essentially inelastic and dimensionally stable so as to optimally resist being penetrated by the opposite ends of the wire 24 as the brassiere 10 is worn. While various embodiments of the warp knitted fabric of the present invention will be recognized and understood by those persons skilled in the art, one particular preferred embodiment of the fabric is shown diagrammatically in FIG. 3.

As explained more fully herein, the fabric of the present invention is formed on a warp knitting machine which may be of any conventional type of an at least two-bar construction having two or more yarn guide bars and a needle bar, e.g., a conventional tricot warp knitting machine. The construction and operation of such machines are well known in the knitting art and need not herein be specifically described and illustrated. In the following description, the yarn guide bars of the knitting machine are identified as "top" and "bottom" guide bars for reference purposes only and not by way of limitation. As those persons skilled in the art will understand, such terms equally identify knitting machines whose guide bars may be referred to as "front" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 3, each of the top (front) and bottom (back) yarn guide bars of the machine is threaded on every guide eye with a respective set of yarns 40,42 delivered from a respective warp beam (not shown), the yarns being suitable for cooperatively achieving a stabilized ground structure for the knitted fabric, as herein described.

Preferably, all of the yarns are synthetic yarns, nylon being most preferred, and are of a denier generally in the range of 20 to 50 denier. In the particular fabric diagramed in FIG. 3, the yarns 40 of the front (top) guide bar are monofilament nylon-6 yarns of 30 denier, while the yarns 42 of the bottom (back) guide bar are multifilament nylon-6 yarns having 10 filaments cumulatively totaling 40 denier. Of course, those persons skilled in the art will recognize that various other types of yarns may also be employed as necessary or desirable according to the fabric weight, feel and other characteristics sought to be achieved.

Figure 3:
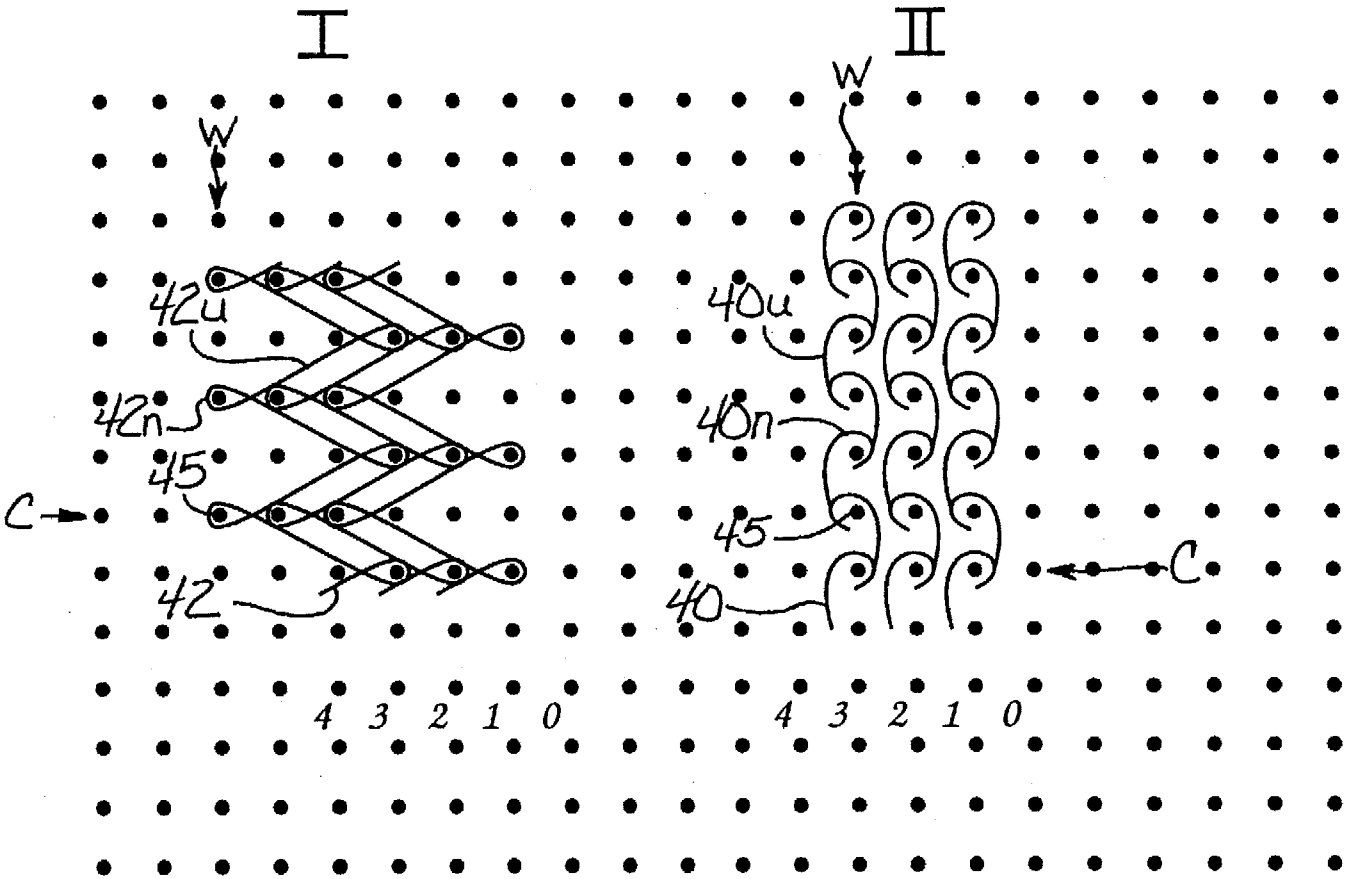
FIG. 3 is a diagram showing individually the stitch patterns for the two sets of warp yarns as carried out by a warp knitting machine in knitting one preferred embodiment of the present fabric according to the method of the present invention.

Referring now to the diagram of FIG. 3, the particular illustrated embodiment of the present warp knitted fabric is of a two-bar construction knitted according to the present invention on a two-bar warp knitting machine. In FIG. 3, the stitch construction of the yarns 40,42, as carried out by the respective lateral traversing movements of the guide bars of the knitting machine according to the present fabric and method, are respectively illustrated individually in a traditional dot or point diagram format, wherein the individual points 45 represent the needles of the needle bar of the knitting machine in the formation of several successive fabric courses C across several successive fabric wales W. According to this embodiment, the top (front) guide bar of the machine manipulates the yarns 40 relative to the needles 45 of the needle bar of the machine to stitch the yarns 40 in a repeating 1-0, 0-1 chain stitch pattern, as indicated at II of FIG. 3, as the yarns 40 are fed progressively from their respective warp beam. Simultaneously, the front (top) guide bar of the knitting machine manipulates the yarns 42 as they are fed from their respective warp beam to traverse relative to the needles 45 to stitch the yarns 42 in a repeating 1-0, 3-4 stitch pattern, as indicated at I of FIG. 3.

As will thus be understood, the yarns 42 are interknitted with one another in the described stitch construction with each yarn 42 being formed in needle loops 42*n* alternating every course C between a pair of vertical fabric wales W spaced apart by two intervening wales W and in connecting underlaps 42*u* extending diagonally between the successive needle loops 42*n*. The yarns 40 are interknitted with one another and with the yarns 12 with each yarn 40 being formed in a chain of needle loops 40*n* aligned vertically in a common wale W, the needle loops 40*n* being interknitted in plated relationship with the needle loops 42 of the yarns 42 in the respective wales, and in relatively short walewise underlaps 40*u*.

As will thus be understood, the yarns 42 extend predominantly coursewise at the technical face of the fabric, the coursewise orientation of the underlaps 42*u* serving to provide the fabric with structural stability and resistance to elongation in the coursewise direction. The yarns 40 appear predominantly walewise at the technical back of the fabric, the walewise alignment and orientation of the chain stitch pattern thereof serving to provide the fabric with structural stability and resistance to elongation in the walewise direction.

To optimize the stitch density and structural integrity of the fabric, the needle and guide bars of the warp knitting machine are preferably selected to have a relatively fine gauge, preferably on the order of at least about 40 needles and guide eyes per inch in each needle and guide bar. In turn, the various adjustable settings of the knitting machine, e.g., tension, run-in, take-up settings, etc., are selectively set to provide a similar stitch density in the walewise direction. In the preferred fabric embodiment illustrated, the completed fabric has at least about 40 wales and 80 courses per square inch of fabric.

It is additionally preferred to selectively provide in the fabric a limited predetermined degree of walewise elongation to the fabric, which enables the fabric to be wrapped in conformity about the underwire 24 without wrinkles, folds or creases, thereby enhancing the comfort and feel of the fabric to the wearer. Such controlled degree of warpwise elongation is achieved in the present invention by selectively setting the relative run-in lengths of the yarns 40,42, with due consideration to their differing stitch patterns, in order that the chain stitches 40*n* of the warp yarns 40 are slightly larger than the needle loops 42*n* of the yarns 42, whereby the chain stitches 40*n* become canted in alternating coursewise inclination relative to the walewise extent of the yarns 40. In this manner, upon application of a warpwise elongation force to the fabric, the fabric is permitted to elongate to the limited extent of drawing the chain stitches 40 out of their inclined cant and into alignment with one another. With the warp yarns 40,42 knitted in the described stitch patterns, the run-in ratio for the warp yarns 40 relative to the warp yarns 42 should be preferably in the range between 1.7:1 and 1.9:1.

Subsequent to the fabrication of the fabric of FIG. 3, the present invention provides for finishing treatment of the fabric to enhance its physical characteristics, particularly its resistance to abrasive forces, so as to perform optimally in the brassiere 10. As will be understood by persons skilled in the art, the nylon yarns 40,42 inherently provide superior abrasion resistance in comparison to polyester yarns of the same denier due to the higher per-denier tenacity of nylon. Such abrasion resistance can be enhanced even further by chemical treatment of the fabric. Conventional brassiere fabrics are typically subjected to a dyeing process by any conventional form of textile dyeing equipment, e.g., beam dyeing, and then transported under predetermined longitudinal and transverse tensioning through a heat setting range wherein the fabric is subjected to an elevated temperature to dimensionally set the fabric.

According to the present invention, a chemical finish composition containing a combination of an acrylic-based finish and a silicone-based finish dispersed or dissolved in a suitable carrier liquid is applied by a pad-type process to the surface of the fabric immediately prior to or during travel through the heat set range. Advantageously, this combination of finish compositions in a single bath serves to enhance the fabric's ability to resist fraying and other abrasive forces while at the same time imparting a softer hand and feel to the fabric. A preferred form of acrylic-based composition is the POMOCO AAF liquid polymer commercially manufactured and distributed by Piedmont Chemical Industries, Inc., Post Office Box 2728, High Point, N.C. 27261. A suitable form of silicone-based composition compatible with the POMOCO AAF acrylic composition is the SYNTHASIL GS 6, also manufactured and distributed by Piedmont Chemical Industries, Inc. These compositions are preferably mixed in dispersion in water or another suitable carrier liquid to provide a 20% dispersion of the POMOCO AAF polymer and a 5% dispersion of the SYNTHASIL GS 6 silicone composition. Of course, those persons skilled in the art will recognize that other concentrations of the constituent chemical compositions in the finish, and other combinations of chemical compositions, may also be possible to achieve comparable results in abrasion resistance and appropriate fabric hand.

Advantageously, the novel fabric of the present invention, when incorporated as described into an underwire brassiere such as the brassier 10 as a covering material for the stiffening underwire, uniquely conforms to the shape of the underwire without developing wrinkles, folds or creases in the fabric and the fabric has enhanced structural and dimensional stability in comparison to conventional taffeta woven fabrics. Such characteristics combine to provide superior resistance to being penetrated by the underwire. At the same time, the knitted structure and improved hand resulting from the finish treatment of the fabric provides greater comfort and feel in comparison to conventional stabilized tricots.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile fabric of a warp knitted construction characterized by a generally inelastic and dimensionally stable stitch structure adapted for use as an underwire covering in a brassiere of the type having a supporting underwire shaped in conformity to a wearer's breasts, the fabric comprising a plurality of generally inelastic yarns interknitted with one another in stitches arranged in longitudinally extending fabric wales and transversely extending fabric courses, the yarns comprising a first set of yarns each warp knitted in a pattern of coursewise spaced stitches with extended underlaps therebetween for providing structural stability and elongation resistance coursewise of the fabric and a second set of yarns each warp knitted in a pattern of walewise aligned chain stitches for providing structural stability and elongation resistance walewise of the fabric, the chain stitches of the second yarns being canted in a coursewise inclination relative to the walewise alignment of the second yarns for providing the fabric with a predetermined degree of walewise elongation to promote conformation of the fabric to the shape of the underwire in fabrication of the brassiere.

2. A warp knitted textile fabric for use as a brassiere underwire covering in accordance with claim 1, wherein the fabric is of a relatively fine gauge having the stitches of the first and second sets of warp yarns sufficiently closely spaced for promoting dimensional stability and resisting penetration of the fabric by the underwire.

3. A warp knitted textile fabric for use as a brassiere underwire covering in accordance with claim 2, wherein the first and second sets of warp yarns are of a denier in the range of approximately 20 denier to approximately 50 denier.

4. A warp knitted textile fabric for use as a brassiere underwire covering in accordance with claim 3, wherein the warp yarns of the first set are of approximately 40 denier, the yarns of the second set are of approximately 30 denier, and the fabric has at least about 40 wales and 80 courses per square inch of fabric.

5. A warp knitted textile fabric for use as a brassiere underwire covering in accordance with claim 1, wherein the first and second sets of warp yarns are nylon.

6. A warp knitted textile fabric for use as a brassiere underwire covering in accordance with claim 5, wherein the first and second sets of warp yarns are of a denier in the range of approximately 20 denier to approximately 50 denier.

7. A warp knitted textile fabric for use as a brassiere underwire covering in accordance with claim 6, wherein each warp yarn of the first set is a multifilament nylon yarn of approximately 40 denier and each warp yarn of the second set is a monofilament nylon yarn of approximately 30 denier.

8. A warp knitted textile fabric for use as a brassiere underwire covering in accordance with claim 1, wherein the first set of warp yarns are warp knitted in a 1-0, 3-4 stitch pattern and the second set of warp yarns are warp knitted in a 1-0, 0-1 stitch pattern.

9. A warp knitted textile fabric for use as a brassiere underwire covering in accordance with claim 1 and further comprising an abrasion resistant finish on the surface of the fabric.

10. A warp knitted textile fabric for use as a brassiere underwire covering in accordance with claim 9, wherein the abrasion resistant finish comprises a finish composition combined of an acrylic-based composition and a silicone-based composition.

11. An underwire brassiere comprising a pair of adjoining breast cups, each breast cup defining an underwire channel extending along a lower margin of the breast cup for disposition immediately beneath a wearer's breasts, and at least one supporting underwire shaped in conformity with the lower margins of the breast cups and extending within the channels thereof, each channel comprising a generally inelastic and dimensionally stable warp knitted textile fabric comprising a plurality of generally inelastic yarns interknitted with one another in stitches arranged in longitudinally extending fabric wales and transversely extending fabric courses, the yarns comprising a first set of yarns each warp knitted in a pattern of coursewise spaced stitches with extended underlaps therebetween for providing structural stability and elongation resistance coursewise of the fabric and a second set of yarns each warp knitted in a pattern of walewise aligned chain stitches for providing structural stability and elongation resistance walewise of the fabric, the chain stitches of the second yarns being canted in a coursewise inclination relative to the walewise alignment of the second yarns for providing the fabric with a predetermined degree of walewise elongation to promote conformation of the fabric to the shape of the underwire in fabrication of the brassiere.

12. An underwire brassiere according to claim 11, wherein the fabric is of a relatively fine gauge having the stitches of the first and second sets of warp yarns sufficiently closely spaced for promoting dimensional stability and resisting penetration of the fabric by the underwire.

13. An underwire brassiere according to claim 12, the first and second sets of warp yarns are of a denier in the range of approximately 20 denier to approximately 50 denier.

14. An underwire brassiere according to claim 13, wherein the warp yarns of the first set are of approximately 40 denier, the yarns of the second set are of approximately 30 denier, and the fabric has at least about 40 wales and 80 courses per square inch of fabric.

15. An underwire brassiere according to claim 11, wherein the first and second sets of warp yarns are nylon.

16. An underwire brassiere according to claim 15, wherein the first and second sets of warp yarns are of a denier in the range of approximately 20 denier to approximately 50 denier.

17. An underwire brassiere according to claim 16, wherein each warp yarn of the first set is a multifilament nylon yarn of approximately 40 denier and each warp yarn of the second set is a monofilament nylon yarn of approximately 30 denier.

18. An underwire brassiere according to claim 11, wherein the first set of warp yarns are warp knitted in a 1-0, 3-4 stitch pattern and the second set of warp yarns are warp knitted in a 1-0, 0-1 stitch pattern.

19. An underwire brassiere according to claim 11 and further comprising an abrasion resistant finish on the surface of the fabric.

20. An underwire brassiere according to claim 19, wherein the abrasion resistant finish comprises a finish composition combined of an acrylic-based composition and a silicone-based composition.

21. A method of warp knitting a generally inelastic and dimensionally stable textile fabric to be adapted for use as an underwire covering in a brassiere of the type having a supporting underwire shaped in conformity to a wearer's breasts, the method comprising the steps of warp knitting a plurality of warp yarns with one another in stitches arranged in longitudinally extending fabric wales and transversely extending fabric courses, wherein a first set of warp yarns are warp knitted in a pattern of coursewise spaced stitches with extended underlaps therebetween and a second set of warp yarns are simultaneously warp knitted in a pattern of walewise aligned chain stitches for cooperatively providing structural stability and elongation resistance both coursewise and walewise to the fabric, the warp knitting of the first and second sets of warp yarns being at selectively differing run-in values for causing the chain stitches of the second set of warp yarns to be canted in a coursewise inclination relative to their walewise alignment for providing the fabric with a predetermined degree of walewise elongation to promote conformation of the fabric to the shape of the underwire in fabrication of the brassieres.

22. A method of warp knitting a textile fabric adapted for use as a brassiere underwire covering in accordance with claim 21 and further comprising knitting the first and second sets of warp yarns at a run-in ratio of the first warp yarns to the second warp yarns of between about 1.7:1 and 1.9:1.

23. A method of warp knitting a textile fabric adapted for use as a brassiere underwire covering in accordance with claim 21 and further comprising knitting the stitches of the warp yarns in sufficiently close spacing to one another to form the fabric of a relatively fine gauge for promoting dimensional stability and resisting penetration of the fabric by the underwire.

24. A method of warp knitting a textile fabric adapted for use as a brassiere underwire covering in accordance with claim 23 and further comprising providing yarns of a denier in the range of approximately 20 denier to approximately 50 denier as the first and second sets of warp yarns.

25. A method of warp knitting a textile fabric adapted for use as a brassiere underwire covering in accordance with claim 24 and further comprising providing yarns of approximately 40 denier as the first set of warp yarns and yarn of approximately 30 denier as the second set of warp yarns, and forming at least about 40 wales and 80 courses per square inch of fabric.

26. A method of warp knitting a textile fabric adapted for use as a brassiere underwire covering in accordance with claim 21 and further comprising providing nylon yarns as the first and second sets of warp yarns.

27. A method of warp knitting a textile fabric adapted for use as a brassiere underwire covering in accordance with claim 26 and further comprising providing yarns of a denier in the range of approximately 20 denier to approximately 50 denier as the first and second sets of warp yarns.

28. A method of warp knitting a textile fabric adapted for use as a brassiere underwire covering in accordance with claim 27 and further comprising providing multifilament nylon yarns of approximately 40 denier as the first set of warp yarns and monofilament nylon yarns of approximately 30 denier as the second set of warp yarns.

29. A method of warp knitting a textile fabric adapted for use as a brassiere underwire covering in accordance with claim 21 and further comprising warp knitting the first set of warp yarns in a 1-0, 3-4 stitch pattern and warp knitting the second set of warp yarns in a 1-0, 0-1 stitch pattern.

30. A method of warp knitting a textile fabric adapted for use as a brassiere underwire covering in accordance with claim 21 and further comprising applying an abrasion resistant finish to the surface of the fabric.

31. A method of warp knitting a textile fabric adapted for use as a brassiere underwire covering in accordance with claim 30 and further comprising applying to the surface of the fabric a finish composition combined of an acrylic-based composition and a silicon-based composition.

* * * * *